United States Patent [19]

Kincaid, Jr.

[11] 4,079,586

[45] Mar. 21, 1978

[54] AUTOMATIC STEAM PRESSURE GENERATOR

[76] Inventor: Elmo Kincaid, Jr., 1660 Ashley Dr., Clarkston, Wash. 99403

[21] Appl. No.: 678,987

[22] Filed: Apr. 21, 1976

[51] Int. Cl.[2] ..... F02C 7/00; F02C 7/34

[52] U.S. Cl. ..... 60/39.07; 60/39.55; 60/39.68

[58] Field of Search ..... 60/39.25, 39.53, 39.55, 60/39.60, 39.62, 39.63, 39.68, 39.07

[56] References Cited

U.S. PATENT DOCUMENTS

| | | | |
|---|---|---|---|
| 635,095 | 10/1899 | Fessler | 60/39.6 |
| 969,221 | 9/1910 | Thompson | 60/39.63 |
| 1,806,133 | 5/1931 | Thomas | 60/39.68 |
| 2,140,085 | 12/1938 | Maina | 60/39.55 |
| 3,335,565 | 8/1967 | Aquet | 60/39.55 |
| 3,708,976 | 1/1973 | Berlyn | 60/39.63 |

*Primary Examiner*—Carlton R. Croyle
*Assistant Examiner*—L. J. Casaregola
*Attorney, Agent, or Firm*—Chernoff & Vilhauer

[57] ABSTRACT

An automatic steam pressure generator comprises compression means to compress ambient air, power means to power the compression means, an air receiving tank to store the compressed air, continuous combustion burner means to burn fuel with the compressed air providing a high pressure, high temperature combustion product, water injection means to inject water into the combustion products providing a lower temperature mixture of steam and combustion products, and a steam storage tank to store the mixture of steam and combustion products. Steam supply control means and burner control means are responsive to the pressure in the steam storage means regulating the amount of the mixture that is produced in order to provide automatically a relatively constant pressure supply of the mixture.

1 Claim, 7 Drawing Figures

AUTOMATIC STEAM PRESSURE GENERATOR

BACKGROUND OF THE INVENTION

This invention relates to a steam pressure generator. It relates in particular to such a generator wherein water is injected into the combustion products of a continuous combustion burner.

External continuous combustion engine are well known in the prior art. They are exemplified by steam engines and turbines. In addition the use of water injection in conjunction with piston type engines is well known. However, water injection has been restricted in the prior art to those engines utilizing internal combustion means.

In addition the injection of water into the products of combustion of an external burner whereby the combination of the combustion products and water are then introduced into pistons is known in the prior art. In particular an engine of this type is shown in U.S. Pat. No. 3,651,641. This engine utilizes a cycle much the same of that of the engine of the present engine. However, the burner unit is not of the continuous combustion type and receives high pressure compressed air cyclically directly from a compression piston.

Due to the particular hardware shown in the prior art engines, they necessarily must be of the intermittent compression type. Otherwise, there would be too great of heat loss from the compressed air to give the required efficiency.

Accordingly, it is the general purpose of the present invention to provide an automatic steam pressure generator of the continuous external combustion type having water injected into the products of combustion.

It is the further object of the present invention to provide such a generator having controls to automatically provide a supply of steam at a constant pressure over a varying rate of demand.

It is a further object of the present invention to provide such a generator wherein the control means prevents an accumulation of unburned fuel in the burner.

It is a further object of the present invention to provide such a generator which may also be self contained to provide a prime mover.

THE DRAWINGS

The manner in which the foregoing and other objects of the invention are accomplished will be apparent from the accompanying specification and claims, considered together with the drawings wherein:

GENERAL STATEMENT OF THE INVENTION

The present invention generally provides an automatic pressure generator comprising compression means to compress ambient air, power means to power the compression means, an air receiving tank to store the compressed air, continuous combustion burner means to burn fuel in the compressed air providing high pressure, high temperature combustion products, water injection means to utilize the high heat of combustion before usual rapid loss of heat by expansion of the injected water into steam while maintaining the same pressure and volume and providing a lower temperature mixture of steam and combustion products, and steam storage means to store the mixture of steam and combustion products.

The generator unit includes the necessary controls to make its operation fully automatic allowing the generator unit to supply a continuous relatively constant pressure source of steam under varying demand conditions.

DETAILED DESCRIPTION OF A PREFERRED EMBODIMENT

Figure 1:
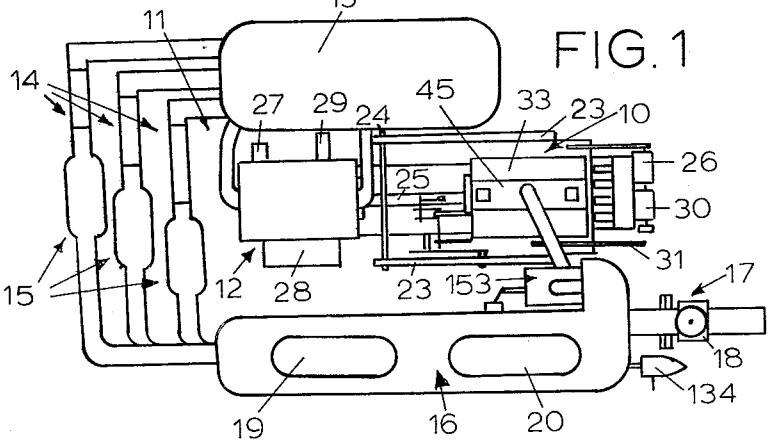
FIG. 1 is a diagrammatic plan view, showing the various elements of the present invention and their relationship to one another.

Referring to FIG. 1, the automatic steam pressure generator of the present invention generally comprises compression means 10 to compress ambient air, a water preheater 11 utilizing the heat of compression to preheat injection water, power means 12 to power the compression means, an air receiving tank 13 to store the compressed air, variable volume external continuous combustion burner means 14 to burn fuel in the compressed air, and water injection and steam making means 15 to inject water into the combustion products of the burner. Steam storage means 16 stores the resulting mixture of steam and combustion products, distribution means 17 distributes the mixture to an appropriate steam powdered device or steam type engine, and closure means 18 closes the distribution means when desired. High pressure water supply tank 19 and high pressure injection fuel tank 20 stores the injection water and fuel, respectively. Automatic steam control means 153 controls the power means. Crank shaft 22 is interconnected by connecting rods 23 to cross beam 24 which is joined to piston and cylinder activating shaft 25. Auxiliary equipment includes electric generator 26, voltage regulator 27, chargeable battery 28, spark coil 29, starter 30, and flywheel 31.

Figure 2:
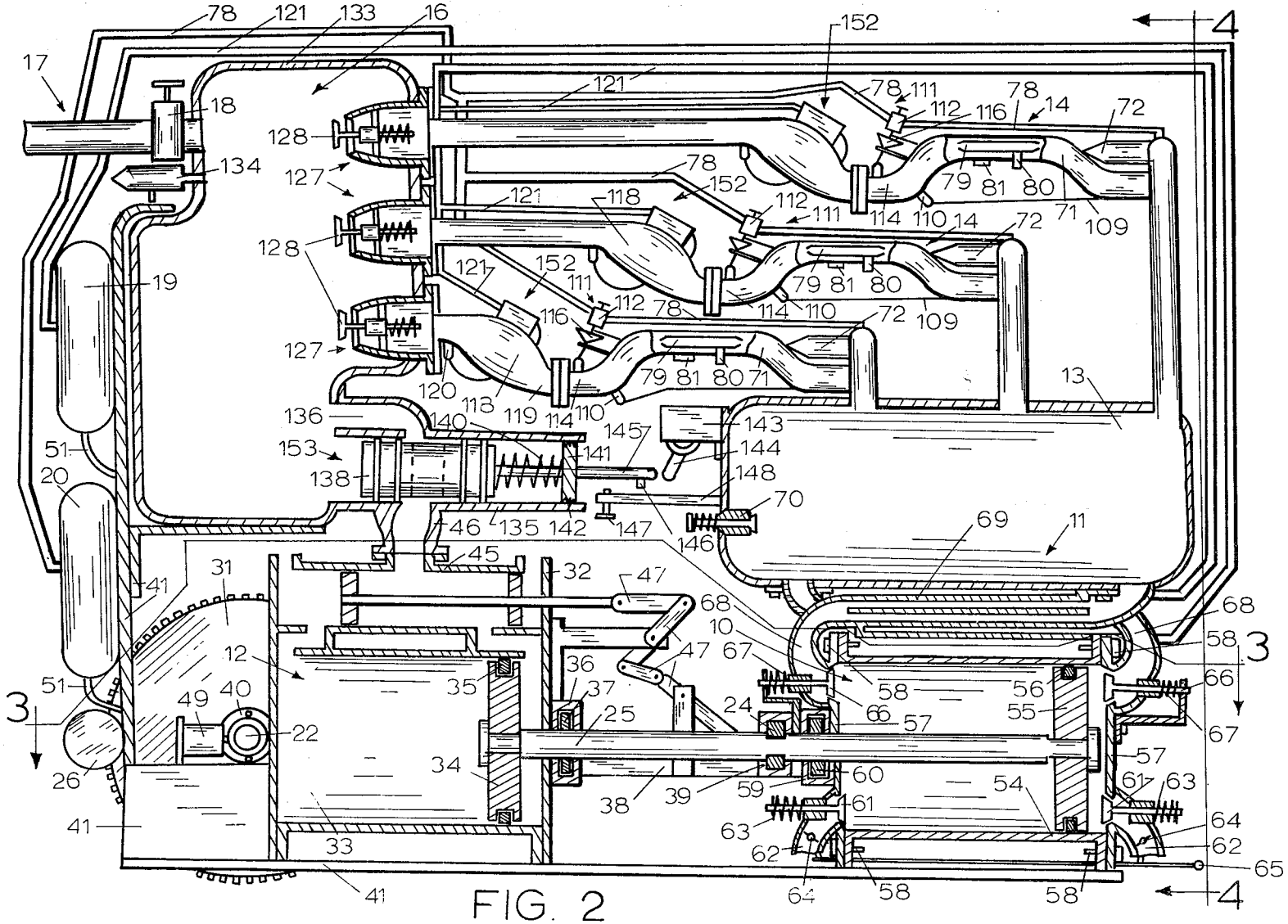
FIG. 2 is a diagrammatic, longitudinal view, partially broken away, of a second embodiment of the generator of the present invention.
Figure 3:
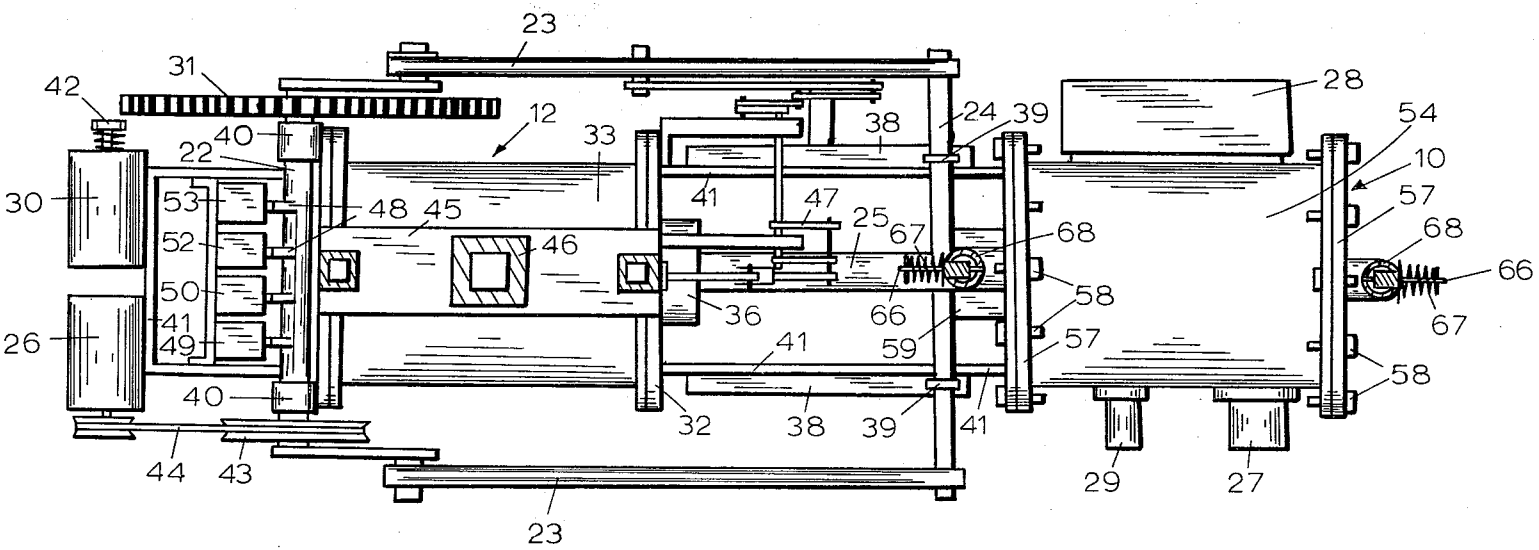
FIG. 3 is a diagrammatic cross sectional view taken on the line 3—3 of FIG. 2.

Referring to FIGS. 2 and 3, power means 12 includes power cylinder 33 having removable end plate 32 joined to one end. Power piston 34 is configured to communicate slidably within the power cylinder. Rings 35 fit into recessed grooves positioned about the periphery of the power piston to seal it within the cylinder in the normal manner.

Activating shaft 25 is joined at one end to the power piston. The activating shaft passes through a hole in the end plate. Housing 36 having a gland 37 is joined to the end plate outwardly adjacent the hole to seal the activating shaft as it passes therethrough.

Cross beam 24, FIGS. 1, 2, and 3, is kept aligned by slides 38 and guides 39. Crank shaft 22 is journaled in bearings 40 which are supported by power cylinder 33 and body member 41. It will be noted that the power cylinder 33 is also supported by the body member.

Flywheel 31 is joined to one end of the crank shaft. The flywheel contains peripheral teeth configured for engagement with gear 42 of electric starter motor 30. Pulley 43 is joined to the other end of the crank shaft to operate electric generator 26 by means of V-belt 44. Voltage regulator 27 regulates the output of the generator to storage battery 28. Wiring means (not shown) interconnect the aforementioned electrical elements.

Sleeve valve 45 is connected to power cylinder 33 to introduce working fluid, such as steam, therein in a timed fashion to operate power piston 34. The sleeve valve is joined to the working fluid source by steam supply pipe 46. The sleeve valve is activated by means of linkage 47 which is connected to one of connecting rods 23. Cams 48 are located in the center area of the crankshaft.

Cams 48, joined to the crank shaft, activate fuel pump 49 and water pump 50 to supply pressurized fuel to fuel supply tank 20 and pressurized water to water supply tank 19. Tubing 51 interconnect the pumps to their respective tanks. Fuel and water supply lines (not shown) supply the fuel and water to the pumps. Lubricating oil pump 52 and steam oil pump 53 supply oil to their respective elements.

Compression means 10 includes compression cylinder 54 which is mounted to body member 41. Compression piston 55 slidably communicates within the compression cylinder. Rings 56 fit into recessed grooves in the periphery of the compression piston to seal it within the compression cylinder. The compression piston is joined to the other end of activating shaft 25. Thus it is linked to power cylinder 33 for movement therewith.

Heads 57 are joined to each end of the compression cylinder, such as by bolts 58. A hole in the head which is adjacent the power cylinder allows passage of the activating shaft. Housing 59 and gland 60 seal the activating rod in the head.

Intake valves 61 are mounted on heads 57 to allow ambient air to be drawn into the compression cylinder through inlet ports 62. The valves are pressure operated to open against springs 63 on the inlet stroke of the compression and close on the compression stroke. Two such valves are shown, one located on each head, thus the compression means will be double acting to increase its efficiency. The inlet ports contain butterfly air inlet control valve 64 having a manually controlled lever 65, for use when the steam generator is in its self powering steam engine mode.

Exhaust valves 66 are mounted on the heads opposite the intake valves. Exhaust valves are also pressure operated to open against springs 67 since, as will be noted below, the compressed air is discharged to a closed pressurized system through exhaust ports 68.

Figure 4:
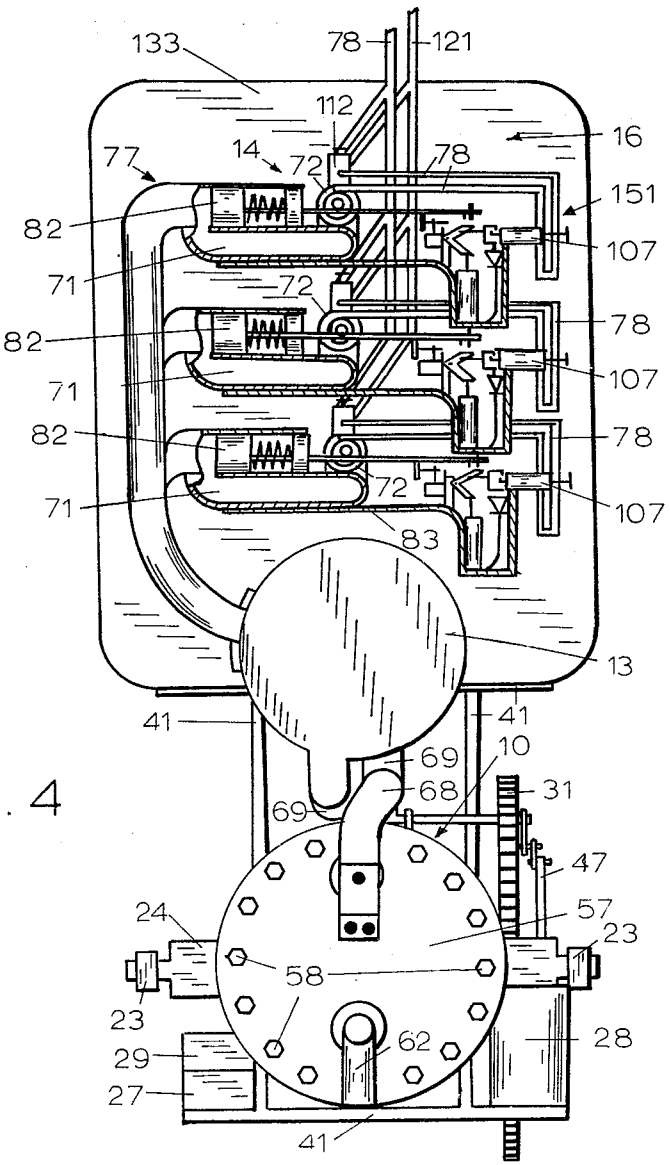
FIG. 4 is a diagrammatic cross sectional view, partially broken away, taken on the line 4—4 of FIG. 2.

The heat generated by compressing ambient air is transferred by heat exchangers 69, FIGS. 2 and 4, to preheat injection water. The injection water is circulated freely in one compartment of the heat exchangers to receive heat from the compressed air which is circulated in the other compartment through the metal walls of the heat exchanger. The heat exchangers are mounted on the exhaust ports 68.

The power piston 34 gains speed during the early part of the air compressing stroke of the compression piston 55 while it is in the extremely low pressure portion of its stroke. The power piston 34 stores its momentum in the heavy flywheel 31, which drives the compression piston 55 to compress the ambient air to higher pressure than that at the powering cylinder 33. To assure flow of the compressed air pressure and the combustion gases and steam, the pressure of the air in the compressed air receiving tank must be the highest pressure in the system. The compressed air and the combustion products and steam flow from this high compressed air pressure on to the work of the steam pressure generator at lower pressure, the advantage of the generator being that only the volume amount of pressure material is increased. After combustion there is no rise in pressure as is common with present internal combustion engines.

For the working steam engines, large diameter low pressure steam type cylinders with their double acting steam type pistons will be utilized as in past steam age use. In keeping with the past steam age use, the basis of this type of power is not high cylinder pressures as in present internal combustion engines, but large diameter cylinders and pistons using low pressure for average loading, and increased pressure for heavier than normal loading. Present internal combustion engines use small high pressure cylinders and are speeded up through gearing to drive heavier loads and in this way accumulate the pressure necessary to accomplish their work.

Air receiving tank 13 includes an irregularly shaped tank, which is joined to heat exchangers 69, for receiving pressurized air from the compression means. Manually operated relief valve 70 is mounted in the tank in order to depressurize it.

External continuous combustion burner means 14, FIG. 4, is joined to the air receiving tank for receiving the pressurized air therefrom. The burner means includes a plurality of individual burner bodies 71. Fuel chambers 72 are located on the burner bodies 71 near their air inlets.

Figure 6:
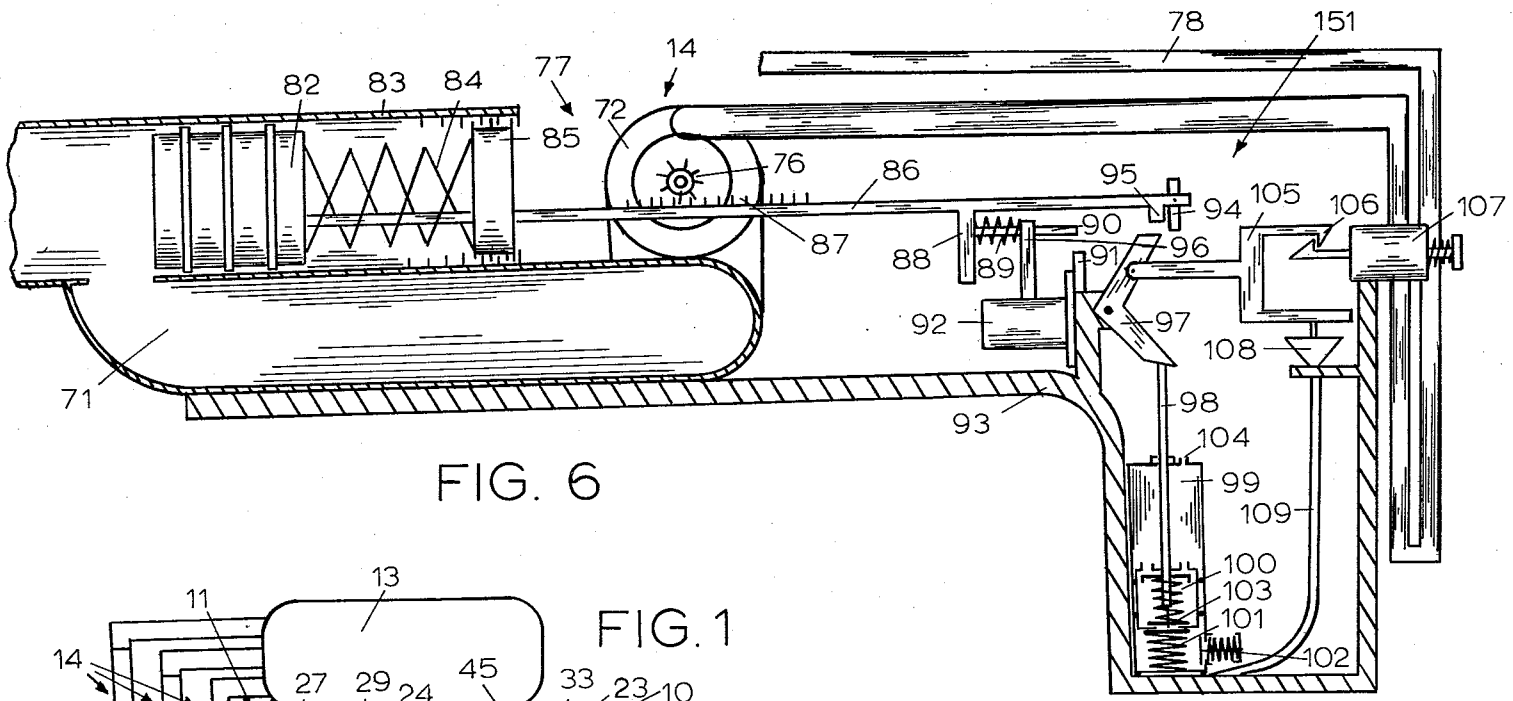
FIG. 6 is a diagrammatic cross sectional plan view, at an enlarged scale, of one of the fuel burner automatic control means and first fuel cutoff means.
Figure 7:
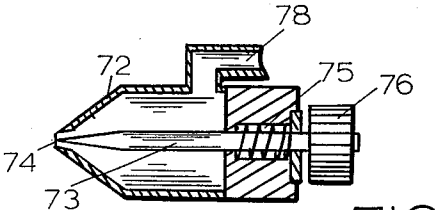
FIG. 7 is a diagrammatic cross sectional plan view, at an enlarged scale, of one of the fuel chambers of the present invention.

The fuel chambers 72, shown in FIGS. 2, 6 and 7, have individual needle valve shafts 73 which communicate with small orifices 74 opening into the respective burner body permitting the high pressure fuel to be sprayed into the high pressure air. The needle valve shafts 73 are equipped with screw threads 75, FIG. 7, which engage threads in the respective fuel chambers. The needle valve shafts are further equipped with attached gears 76 made to operate under control of the burner automatic control means 77. The high pressure fuel supply pipes 78 supply fuel from the high pressure fuel storage tank 20 to the fuel chambers.

Combustors 79 are located medially in each burner body 71 immediately downstream from the fuel chambers. Igniters 80, activated by coil 29 through wires (not shown), are located in the burner bodies to ignite the fuel. The igniters are preferably of the continuous spark type commonly used in jet aircraft engines.

Thermal indicator switches 81 are located on the burner body adjacent each igniter to sense if there is combustion in the burner body associated with that igniter. Indicators (not shown) display the output of the thermal indicator switches.

The burner body automatic control means 77 associated with each burner body individually senses the pressure in the air receiving tank to admit the compressed air and pressurized fuel, and to energize the electric spark in its associated burner body. Referring to FIGS. 4 and 6, ringed piston 82 slidably communicates in ported cylinder 83 which is connected at one end to the air receiving tank. The ringed piston 82 normally is urged by spring 84 to a position covering the port in the cylinder. Threaded collar 85 may be positioned variably in the other end of the cylinder to set the air pressure to the level at which the piston will be displaced against the spring tension admitting air through the uncovered port of the cylinder.

Referring to FIG. 6, action shaft 86 extends from connection to the back of piston 82 through the spring and tension setting collar 85, past the needle valve shaft gear 76. Teeth 87 on the action shaft engage the needle valve shaft gear 76 causing the needle valve shaft to open from its orifice 74 admitting fuel into their respective burner body 71, as the piston 82 uncovers the port to a proportional extent. A combustible mixture of fuel and air is thus admitted to the burner body. At this time the action shaft lever 88 compresses spring 89 on guide pin 90 engaging electric ignition switch toggle 91. The ignition switch 92 is moved to its on position so that the fuel and air mixture now entering the burner body 71 is ignited by action of igniters 80. The ignition switch 92 is spring loaded to return to the off position. The burner body automatic control parts are mounted on frame elements 93.

First safety means 151 comprises action shaft 86 and one way arm element 94 which is supported in a fixed position by tab 95 during outward action shaft movement by air pressure generated behind the ringed piston 82 to move crank 97. Crank 97 comprises an L-shaped element pivotally joined in its medial portion to frame element 93. The upper portion of the crank is positioned to be engaged by arm 94.

The first safety means is provided to prevent an accumulation of unburned fuel in the burner body. The crank 97 rests on piston action rod 98 extending into cylinder 99 and connected to ringed piston 100 which is located slidably in cylinder 99. Outward movement of action shaft 86 moves the crank 97 depressing piston action rod 98 so that the ringed piston 100 compresses spring 101 at the bottom of cylinder 99. The spring loaded inlet air valve 102 located in the cylinder traps the air in the bottom of the cylinder so that it is compressed during the downward movement of the ringed piston 100. Thus spring loaded valve 103 located in the face of the ringed piston 100 is forced open charging the area above the piston with ambient air. As the arm 94 passes the upper portion 96 of the crank 97 the ringed piston 100 under the pressure of spring 101 is able to move upwardly forcing the trapped air out of the upper portion of the cylinder 99 through the small orifice 104 for a short period of time.

Lever 105 is joined pivotally to the upper portion of crank 97. It comprises a horizontal element joined to the vertical leg of a C-shaped element. The upper horizontal leg contains a downward facing hook 106. The hook engages a normally open shut-off valve 107 in fuel supply pipe 78 for closing the valve. Diaphragm 108 is connected by tube 109 to a thermal gas bulb 110 which is located in the associated burner body downstream of the combustor 79, as shown in FIG. 2. The diaphragm is located below the lower horizontal leg of lever 105 so that when the thermostat senses a raised temperature in the associated burner body 71 the diaphragm lifts hook 106 out of engagement with valve 107 so that fuel continues to flow into the ignited burner body.

Figure 5:
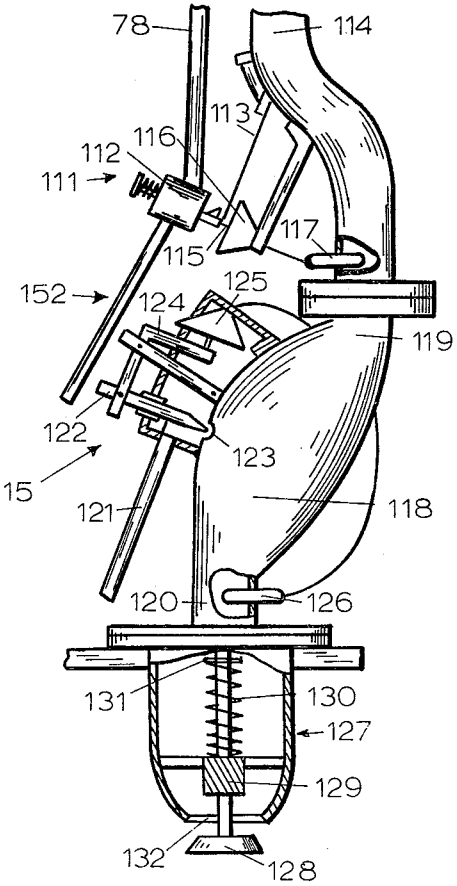
FIG. 5 is a diagrammatic plan view, partially broken away, at an enlarged scale of one of the water injection means and fuel burner second safety means of the present invention.

Second safety means 111, FIG. 5, shuts off the fuel in event the associated burner body flames out after successful startup of combustion or during continual use. Spring loaded fuel valve 112 is located in fuel supply pipe 78 upstream from the burner body fuel input point. The tension of the spring is set to return the valve to its closed position unless the valve is held open. Flat thermal spring steel support 113 is lightly attached to the burner body exit pipe 114 in such a manner that when cold it exerts sufficient pressure on the lower point of the spring loaded fuel valve 112 to keep the fuel valve in the open position. When the burner body is ignited, heat generated in the burner body exit pipe 114 causes the spring steel support 113 to lower until the spring loaded fuel valve is resting on the pin 115 of diaphragm 116. The thermal action of the gas bulb 117 set into the burner body exit pipe 114 is such that when it senses heat it expands the gas contained within it, expanding the diaphragm 116 supporting the spring loaded fuel valve in the open position. If the flame should go out, the thermal action would be such that fuel would be shut off preventing an accumulation of unburned fuel from igniting and causing considerable damage.

Referring to FIG. 5, water injection means 152 are mounted on the downstream end of each burner body 71 to inject water into the combustion products at the point of maximum temperature picking up the heat of combustion, before its usual rapid loss, due to the heat retaining ability of the hydrogen in the water, thus providing a mixture of steam and combustion products from this point on. Each of the water injection means 152 includes an enlarged steam making chamber 118 with its inlet point 119 for receiving the combustion products at the lowest level. The floor of the steam making chamber is inclined upwardly from this low inlet to a high exit 120 so that excess water runs downward on the floor of the chamber toward the incoming high heat of combustion. The high pressure water stored in water supply tank 19 is circulated through water pipes 121 by water pump 50 for preheating in heat exchanger 69, then is vented into the steam making chamber 118 of the water injection means. The water injection needle point pin 122 mounted in the water injection chamber 21 is lifted from orifice 123 so that heated water is sprayed into the hot combustion gases entering from burner body exit pipe 114. The water injection needlepoint pin 122 is lifted by crank 124 which is activated in turn by the thermal action of diaphragm 125 connected to thermal bulb 126 where the sealed gas pressure increases upon sensing the combustion gases entering the steam making chamber.

Also shown in FIG. 5, attached to the exit 120 of the water injection means 152, one way steam exit valve 127 is configured to vent the mixture of steam and combustion products into the steam storage means 16, without back flow into a nonoperative burner body when other burner bodies are in operation, in charging a common steam storage means or tank. Thus dampness is kept out of the nonoperative burner bodies. It is understood that this dampness would prevent proper electrical operation of the igniters 80 as these burner bodies should come into later use due to increased demand for steam pressure. The one way steam exit valve comprises poppet valve 128 with its stem set through guide 129 and spring 130 into spring tension keeper 131 and the spring action valve keeping the poppet valve 128 resting lightly on valve seat 132. The valve is set into the wall of steam storage means 16, as shown in FIGS. 2 and 5.

Steam storage means 16, FIGS. 1, 2 and 4, stores the mixture of combustion and steam. The steam storage means includes tank 133. Relief valve 134 located in the tank regulates the pressure of the mixture. The valve may be manually opened to bleed the tank if desired.

Distribution means 17 joins the steam storage means to distribute the mixture to a working device or steam type engine. Closure means 18 comprises a valve to shut off steam to the connected devices or steam engines when the automatic steam pressure generator is used in an engine mode.

Automatic steam control means 153, FIGS. 1 and 2, supplies a metered amount of steam and combustion products from tank 133 to operate the power means 12. The automatic steam control means 153 is attached to the steam storage tank 133 and to the sleeve valve 45 and regulates the amount of steam passed therethrough. Ported cylinder 135 has upper and lower ports with upper pipe 136 connecting the steam storage tank 133 and the upper port. The lower port is connected by steam supply pipe 46 to the sleeve valve 45. The ported cylinder 135 has one end open into the steam storage tank 133 with a piston 138 slidably fitting within the ported cylinder having one end also facing the steam storage tank 133. The piston 138 has a port through its medial portion with rings fitted on each side of the medial portion to seal the passage of steam through the ports and to retain the steam pressure on the face of piston 138 which faces into the steam storage tank 133. At low pressure or while the generator is at rest, the low steam pressure on the face of the ported piston 138 allows the piston to move forward in the ported cylinder 135 to increase the flow of steam through the ports that are aligned. As the steam pressure builds to the desired pressure in the steam storage tank 133 the pressure is felt on the face of the ported piston 138 forcing the piston back against spring 140. The tension of spring 140 is adjusted by collar 141 set in screw threads 142 to determine the amount of pressure necessary to partially close the ports of the ported cylinder 135 in connection with the ported piston 138.

Electric starter motor switch 143 located on the air receiving tank has toggle lever 144 that is flipped toward the automatic steam control means 153 to start the air compressing and combustion activity. As steam pressure builds in the steam storage tank 133 and ported piston 138 moves away from the steam storage tank in ported cylinder 135, shaft 145 passing through the spring 140 and through the center of the hollow collar 141 reaches the toggle lever 144 and trips it to the off position so that the electric starter motor stops its action at the time when steam pressure has taken over powering of the compression means.

The shaft 145 has catch 146 engaging spring locking latch 147 set on support 148 which is attached to the air receiving tank 13. The latch 147 is set to retain the piston port and the ports of the ported cylinder 135 in the fully aligned position so that steam pressure flows freely therethrough as the automatic steam pressure generator is used in the engine mode. In the engine mode the butterfly inlet air control valves 64 are used under manual control by manual control lever 65 to control the speed of the generator. Relaxing of the tension on spring 84 by means of threaded collars 85 at the burner body automatic control means is necessary in the engine mode to make possible operation of the generator with small amounts of compressed air, up to maximum of 100 pounds pressure. In the engine mode the power is taken from the automatic steam pressure generator crankshaft 22. If desired the automatic control means could be deleted and replaced with a pipe connecting the steam storage tank 133 with sleeve valve 45. In the engine mode the distribution means 17 is closed by closure means 18. The engine mode low pressures would require use of coal as fuel, as petroleum products require high combustion pressures for economical use.

Variable volume external combustion burner means 14 is shown in the drawing with several burner bodies 71 each complete in operation on its own, but operation of each being determined by the tension at which springs 84 are set. Thus one burner body would come into operation, for example, at 90 pounds compressed air pressure in air receiving tank 13, a second burner body would come into operation at 95 pounds compressed air in the air receiving tank, and a third burner body would come into operation at 100 pounds pressure in the air receiving tank. These alternate settings would be used for vehicles or engine uses that would use varying amounts of steam at various power demand setting. A truck with load, for instance, would require only one burner body in operation in the city. At highway speeds this truck would use two burner bodies since demand would be greater to maintain higher speeds. On hills and at higher speeds the same truck would use all three burner bodies or more depending on the basic design needs. In some models, such as a light car, only one burner body would be used at all times.

With use of steam by a connected steam device or steam engine when there is a drop in pressure in the tank 133, the automatic steam control means 153 are activated to speed up the action of the power means 12. Since the power means is directly connected to the compression means 10, the compression of air also increases. This increase of compressed air in the air receiving tank 13 activates the burner body automatic control means 77 to increase burner activity which in turn increases the activity of the water injection means 152 resulting in more steam being made in the steam making chamber 118. The increased amount of steam in the hot combustion gases resulting from increased burner activity flows into the steam storage means 16 to increase the steam and combustion gases pressure there. This increased pressure in the steam tank 133 pushes the automatic steam control means piston 138 back to cut down the amount of steam and combustion gases flowing into the sleeve valve 45 which in turn slows down the action of the power means 12. Thus it is seen that the supply of compressed air, burner activity, resulting steam making activity, and pressure in the steam storage tank automatically balances and is controlled by the variation of steam and combustion products drawn off to a working device or steam engine by distribution means 17. The excess steam and combustion gas pressure accumulating in the steam tank 133 when the connected steam device or steam engine is stopped are bled from the tank into the atmosphere by relief valve 134. Thus the automatic steam pressure generator idles with slow movement until such time as the connected steam device or steam type engine is again started up.

The automatic steam pressure generator initially is started up by flipping the electric starter motor switch 143, and thereafter the operation of the automatic steam pressure generator is fully automatic and continuous until the fuel shut-off valves 107 are shut off to stop the activity of the automatic steam pressure generator.

Not shown are the general water supply tank, general fuel supply tank, or steam oil supply tank or any reserves of lubricating oil. These parts normally are external to the apparatus and can be connected to the automatic steam pressure generator when it is placed in use.

Having thus described my invention in a preferred embodiment, I claim:

1. An automatic steam pressure generator comprising:

(a) compression means configured for compressing ambient air;

(b) power means operatively connected to the compression means and configured for powering thereof;

(c) heat exchanger means configured for receiving the compressed air from the compression means and transferring heat therefrom to preheat injection water;

(d) an air receiving tank joined to the compression means for receiving the compressed air after it leaves the heat exchanger means;

(e) continuous combustion burner means connected to the air receiving tank and configured to burn fuel supplied thereto with the compressed air producing high-pressure, high-temperature combustion products;

(f) water injection means joined to the burner means and configured for injecting the preheated injection water into the combustion products providing a lower temperature mixture of steam and combustion products;

(g) steam storage means connected to the water injection means for storing the mixture of steam and combustion products;

(h) automatic steam control means located between the steam storage means and the power means and configured to supply a metered portion of the mixture of steam and compressed combustion products from the steam storage means to the power means for the operation of the power means, said metered portion being inversely proportional to the pressure in the steam storage means, thereby maintaining a relatively constant pressure in the steam storage means during distribution of a variable amount of the mixture through the distribution means; and (i) said automatic steam control means comprising: a cylinder having a first cylinder port connected to the steam storage means and a second cylinder port connected to the power means and aligned with the first port; said cylinder being open at one end to the steam storage means; a piston configured for free sliding travel within the cylinder, having a medial port passing therethrough, said medial port being in alignment with the first and second cylinder ports, and said piston being sealed in the cylinder outwardly on both sides of said medial port; a spring engaging the piston and urging it to a position toward the end of the cylinder open to the steam storage means in a manner such that the medial port of the piston normally is in alignment with the first and second cylinder ports; and adjustment means adjustably located in the cylinder configured for engaging the spring, allowing adjusting its tension in a manner such that the increasing pressure in the steam storage means causes increasing misalignment of the medial port and the piston with the first and second cylinder ports respectively, and that at a predetermined pressure said respective associated ports are in slight alignment.

* * * * *